US005295606A

United States Patent [19]

Karwoski

[11] Patent Number: 5,295,606

[45] Date of Patent: Mar. 22, 1994

[54] TRASH CONTAINER

[76] Inventor: Alexander Karwoski, 53 Francis Myers Rd., New Britain, Pa. 18901

[21] Appl. No.: 38,825

[22] Filed: Mar. 29, 1993

[51] Int. Cl.[5] ..... B65D 7/04

[52] U.S. Cl. ..... 220/403; 220/404; 220/908

[58] Field of Search ..... 220/908, 404, 403

[56] References Cited

U.S. PATENT DOCUMENTS

| | | | |
|---|---|---|---|
| 3,997,072 | 12/1976 | Guth | 220/908 |
| 4,167,271 | 9/1979 | Jorgensen | 220/908 |
| 4,280,676 | 7/1981 | Betts | 220/908 |
| 4,281,813 | 8/1981 | Garrity | 220/908 |
| 4,331,341 | 5/1982 | McKeown | 220/908 |
| 4,643,380 | 2/1987 | Copeland | 220/908 |
| 4,951,831 | 8/1990 | Roesch et al. | 220/908 |
| 4,991,500 | 2/1991 | Knapp | 220/908 |

*Primary Examiner*—Joseph Man-Fu Moy
*Attorney, Agent, or Firm*—Joseph W. Molasky & Associates

[57] ABSTRACT

A trash container having a drum whose shape is in a form of a truncated cone on a dolly. The drum, which is open at the top and bottom and includes openings along its surface, is positioned upon the dolly for easy moving and positioning. A trash liner is located within the drum such that when the liner is filled, the dolly is rolled to a disposal pick-up site. The drum is first lifted and the filled liner is then removed from the dolly. After depositing the liner, the drum is returned to the dolly.

9 Claims, 3 Drawing Sheets

TRASH CONTAINER

BACKGROUND OF THE INVENTION

This invention relates, in general, to the field of trash collection and, in particular, relates to a container apparatus for receiving and disposing of trash.

It is sometimes the practice where large amounts of trash are produced, such as in areas where many people congregate, to position large receptacles in place. The receptacle in use on many occasions is a fifty-five gallon cylindrical steel or plastic drum. A large plastic bag is normally placed in the drum which receives the deposited trash and, when filled, the bag is removed for eventual placement in a dump site.

A recognized problem with this arrangement is that, when the plastic liner is filled and is ready for removal, the lifting aspect of the trash becomes onerous. The reason for this is that when the plastic liner bag becomes filled, its outside surface hugs the inside surface of the drum. In other words, the filled bag forces the air from between the metal drum and the plastic bag thereby creating a partial vacuum. The creation of the partial vacuum causes the removal of the liner to be difficult, thereby greater lifting force is required.

It is therefore an object of the invention to provide a new and improved trash collection apparatus.

SUMMARY OF THE INVENTION

A trash container of the invention comprises a wheeled dolly which is adapted to receive a removable cone-shaped trash drum having a large circular bottom and small circular top opening. The conical drum includes vents for reasons that will become clear hereinbelow. The drum is dimensioned to receive a limp bag whose open end is removably attached or loosely positioned over a rim of the drum provided by its smaller circular opening.

When the bag is filled with trash or other disposable substances, it is secured at its open end by a tie, and is transferred via the dolly to a desired site for pick-up. At the pick-up site, the drum is removed thereby leaving the filled bag resting upon the dolly. The drum is easily separated from the bag due to the vented drum which eliminates a vacuum that might otherwise exist between the inside of the drum and the outside of the bag.

The bag is then removed from the dolly and left at the pick-up site after which the drum is returned to its original position. The dolly and drum are then returned to a desired location.

The apparatus of the invention can be used in another mode of operation where the dolly is not placed in use. In this mode, the truncated cone is used in combination with the plastic liner where the cone is positioned in a location, for example, for collecting leaves or grass clippings. When leaves or grass clippings are being collected, the cone is positioned directly on the ground and the bag is placed within the cone as above-mentioned. In this application, the cone provides stability for the bag so that the leaves or grass clippings can be easily deposited.

The apparatus above-described includes other useful design features which are readily apparent when a plurality of such containers are being utilized as, for example, in large establishments such as hospitals, restaurants, factories and business complexes. Other locations where the invention may be used are fairgrounds and parks. When used in large institutional settings and large establishments, the design of the dolly and drum allows easy stacking of each on top of one another in a suitable location. Therefore, on the day where there is again a need for containers, the drums and dollies are taken to the desired locations where they are unstacked and re-assembled.

DESCRIPTION OF THE PREFERRED EMBODIMENT

Figure 1:
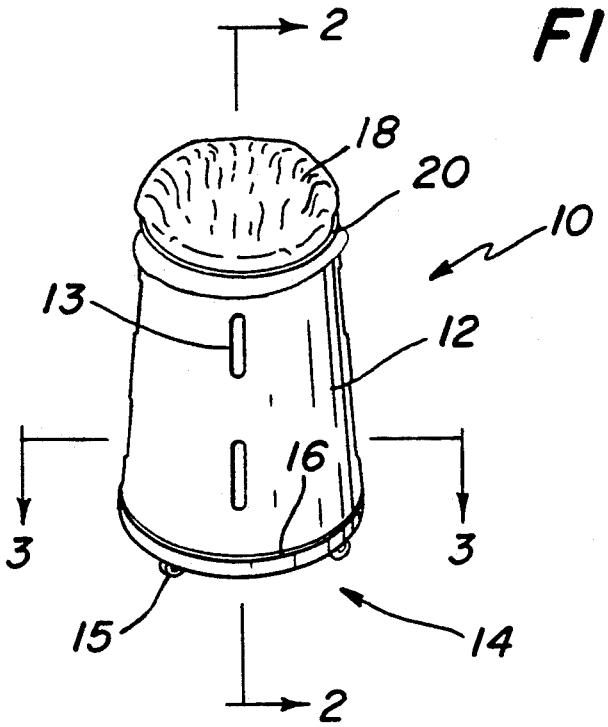
FIG. 1 is a front elevational view of the trash container of the present invention.
Figure 2:
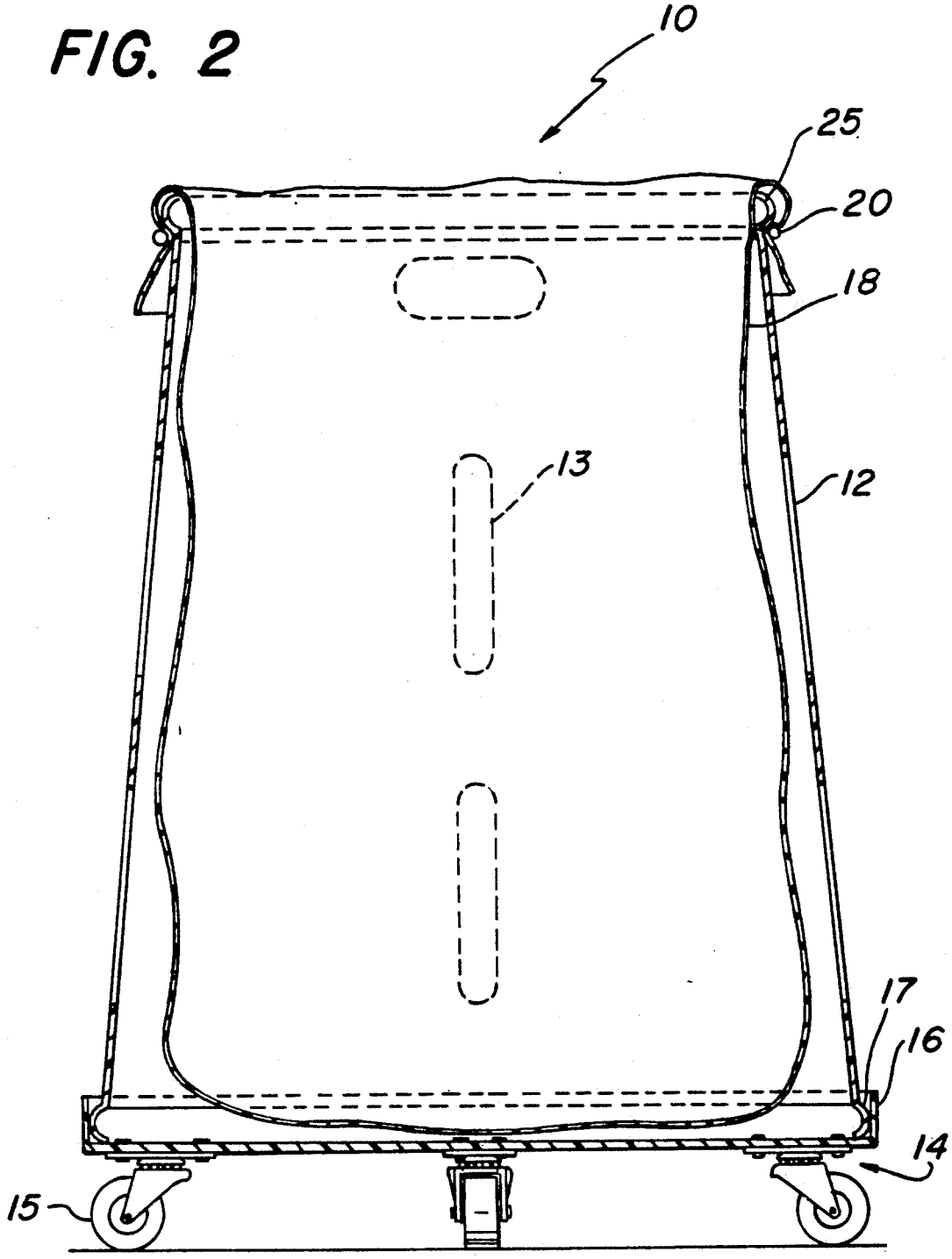
FIG. 2 is a sectional view of FIG. 1 taken along line 2—2.

Reference is now made to FIG. 1 where the trash container assembly 10 of the invention is illustrated. The assembly 10 essentially comprises a drum 12, which is shaped in a form of a truncated cone, and a dolly 14 upon which the drum is placed. The dolly 14 has a circular cross-section and includes a lip 16 for properly receiving the drum 12. Dolly 14 includes swivable wheels 15 located on its undersurface to facilitate movement of the drum 12 to a site for pick-up or disposal as will become clear hereinafter. A plastic liner 18 is located within the drum 12 for receiving trash and is held in place by a tie member 20, which may be an elastic, a flexible plastic or string member. The tie member 20 is located under a ridge 25 which extends beyond the circumference of the drum 12 at this location and provides an optimum positioning location. The top of the liner 18 is positioned over the top of the drum 12, and the tie 20 is wrapped around the inside surface of liner to hold it securely in place. This feature may be viewed with greater clarity in FIG. 2.

Figure 3:
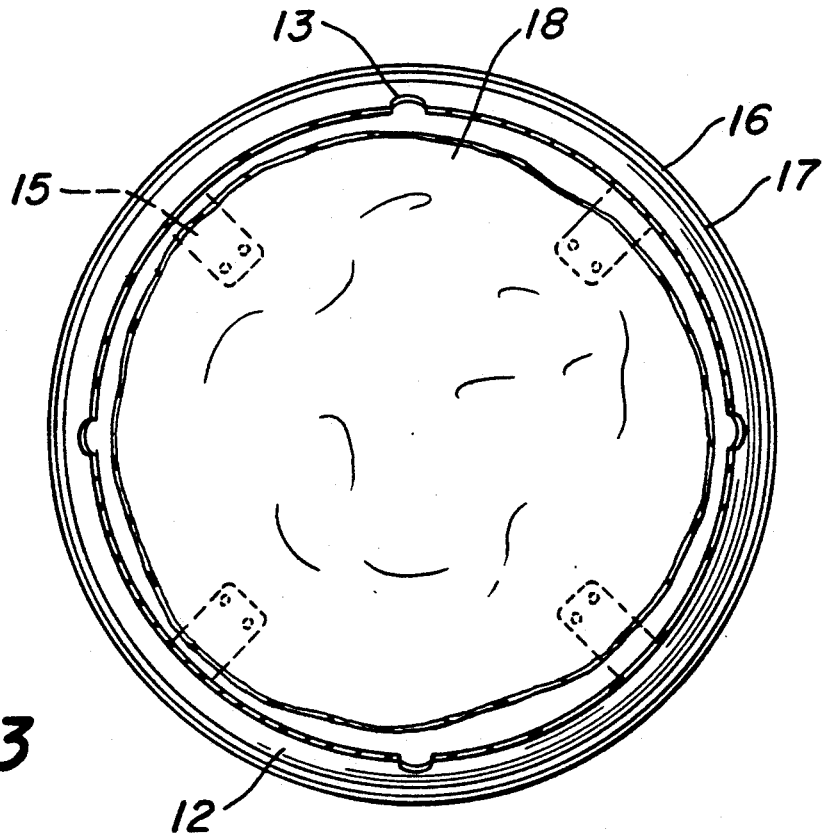
FIG. 3 is another sectional view of FIG. 1 taken along line 3—3.

Positioned along the side of the drum 12 from top to bottom are longitudinal slots 13. The slots 13 are employed to prevent a partial vacuum from being created between the liner 18 and the cone 12 when the latter is filled with trash; in other words, this filling action of liner 18 causes the outside surface of the liner to hug the inside surface of the cone 12 to thereby eliminate air from between the two items to create the partial vacuum. Therefore, the slots 13 of the drum 12 eliminate the vacuum; the wide base of truncated drum 12 also eliminates friction between the plastic bag and the inner surface of the drum. The bottom of the drum 18 provides a bulging rim or protrusion 17 which fits inside the lip 16 on the dolly 14. The protrusion 17 is dimensioned to provide a snug fit with the lip 16 and to further provide for a stable assembly between the drum 12 and the dolly 14. Reference is made to the sectional view of FIG. 3 where the relationship of the lip 16, the protrusion 17, the liner 18, the slots 13, the drum 12, and the swivable wheels 15 with respect to one another are illustrated from a downwardly looking perspective. The slots 13 are illustrated as being located in quadrants of the drum 12 as are the wheels 15; however, the wheels are off-set with respect to the location of the slots.

The operation may be understood with greater clarity by referring again to FIG. 2. In an unassembled state, the drum 12 is first positioned upon the dolly 14 in a semi-permanent arrangement by placing the protrusion 17 against the lip 16 in an upright manner. The liner or bag 18 is located within the cone 12 such that the bag's opening is placed over the top edge 25 of the cone and downwardly. The tie member 20 is then located under the ridge 25 and over the bag 18 in order to maintain the latter in position within the cone-shaped drum 12. When the assembly 10 has been properly combined into a collection unit, it is positioned in a location which will be convenient to drop trash. As the initial trash is collected, it congregates in the bottom of the bag 12 and expands until it contacts the sides of the drum 12. As the bag 18 is eventually filled, contact between it and the drum 12 continues all the way from the bottom to the top.

The use of the assembly 10 can be varied depending upon the intent of the user or owner. In the event that the assembly 10 is owned by a homeowner, the filled bag 18 may be rolled to a curb site from, for example, a garage. The tie member 20 is then removed and the top of the bag is closed with a plastic tie wrap (not shown). Drum 12 is separated from the assembly 10 which will occur easily, and leaves the filled bag resting on the dolly 14. The filled bag 18 is removed from the dolly 14 and left at the curb site for pick-up; thereafter, the drum 12 is re-placed upon the dolly 14 and the assembly 10 is rolled to its original location in the garage.

A portion of assembly 10 may be used in another mode of operation. As an example, the assembly 10 may be used without the dolly 14 for various chores where trash in the form of debris or leaves are required to be picked up. In this mode, the drum 12 with the accompanied attached bag 18 is positioned at a location such as a homeowner's lawn where there is a need to pick up leaves or lawn clippings. Since this portion of the assembly 10 is relatively light in weight, it may be readily moved by lifting from place-to-place where leaf or grass clippings are placed in piles. Again, the bag 18 is filled with debris and, when filled, the tie member 20 is removed so that a plastic tie wrap can be applied to enclose the bag's contents. As described above, the drum 12 is separated from the enclosed bag for later pick-up.

The separated drum 12 is relocated to another site where other leaves or clippings are piled together for eventual bagging. The procedure above-described is repeated until all of the debris is collected and bagged. Upon completion of the collection task, all of the tied bags 18 are transported to a disposal site.

It should be understood, with respect to the above description, that when the contents of the bag allow it to be closely packed as, for example, with grass clippings, the outside surface of liner 18 particularly hugs the inside surface of the conical drum 12. Due to the formation in the present invention of the slots 13 no noticeable attaching effect is produced between the liner 18 and the drum 12 so that the latter may be readily removed from the dolly 14.

Figure 4:
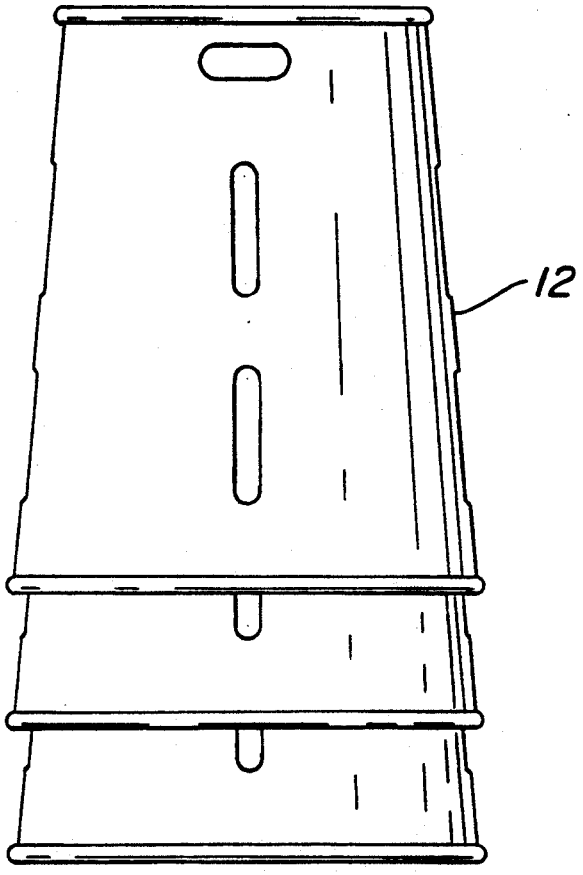
FIG. 4 is a view of the invention illustrating stacking of the drum component of the container apparatus.
Figure 5:
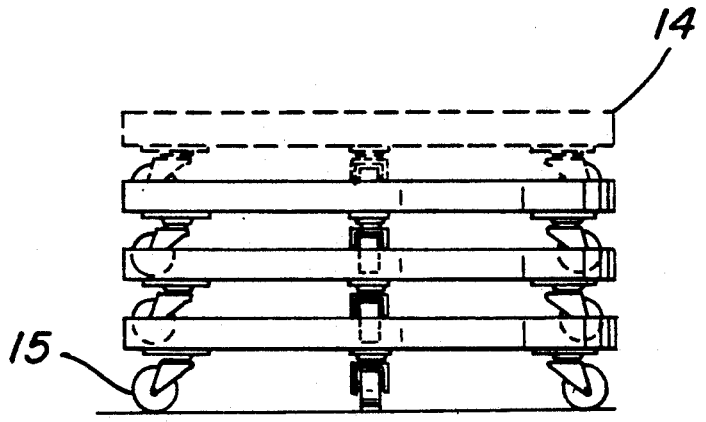
FIG. 5 is a view of the invention depicting a stacking of the dolly component of the container apparatus.

Reference is now made to FIGS. 4 and 5 where the drums 12 and dollies 14 are respectively shown in a stacked position. This is a feature of the invention represented by the assembly 10 particularly where it is used in a park-like atmosphere, or where a great many people congregate in an area. The drums 12 of FIG. 4 are able to be stacked in view of their conical shape; whereas, the wheels 15 are positioned on the underside of the dolly 14 so that they may be stacked by locating each within the circumference of the receiving dolly positioned immediately below.

In summary, a novel trash container has been described and illustrated which facilitates the accumulation of trash. In one mode, the trash container assembly permits trash to be collected in a liner and afterwards transferred by a dolly to a site for pick-up. In a second mode, a portion of the assembly may be utilized to allow for easy pick-up of debris but without use of the dolly. The trash container assembly is also designed for facile stacking when there are a plurality of such units at a location where large numbers of people congregate such as a park, recreation, church, or playground area.

This invention has been described by reference to precise embodiments, but it will be appreciated by those skilled in the art that this invention is subject to various modifications and to the extent that those modifications would be obvious to one of ordinary skill they are considered as being within the scope of the appended claims.

What is claimed is:

1. A two-unit trash container apparatus comprising, a.) a movable means;

b.) a rigid drum means having a shape of a truncated cone and including a small and large opening wherein the larger opening is adapted to be positioned upon said movable means;

c.) means circumferentially surrounding said movable means and rigid drum means positioned to provide a snug fitting arrangement for semi-permanent attachment to one another.

d.) said circumferential surrounding means of said movable means also being dimensioned to locate additional movable means when a plurality are stacked one above another;

e.) means located at approximately each quadrant of said rigid drum for providing air passages to allow atmospheric pressure to penetrate;

f.) means having an entrance positioned within said drum means and upon said movable means for receiving disposable matter, and said air passages eliminating a partial vacuum that is created between said rigid drum means and said receiving means when filled with disposable matter, and g.) said circumferential surrounding means acting as a basin for retaining spillage in the event that said receiving means is damaged.

h.) means for semi-permanently attaching said receiving means to said drum means, i.) whereby when said receiving means is filled and said attaching means is removed, said two-unit container may be transferred to a site by said movable means where said drum means is easily separated by the elimination of said partial vacuum and by operation of said snug fitting, such that said receiving means may be lifted from said movable means for discarding purposes.

2. A trash container apparatus in accordance with claim 1 wherein said movable means comprises a cart having a circular cross section.

3. A trash container apparatus in accordance with claim 2 wherein said cart includes four attached wheels, and said wheels being located at opposite end of intersecting and orthogonal diameters on the underside of said cart to provide balance, and said four wheels being located immediately inside said surrounding means for proper stacking of a plurality of carts one above the other.

4. A trash container apparatus in accordance with claim 1 wherein said means circumferentially surrounding said movable means comprises, a raised lip, and said drum means in a mated state with said movable means being located within said lip.

5. A trash container apparatus in accordance with claim 4 and further comprising, a.) a protrusion surrounding the circumference of the bottom of said drum means to provide said snug fitting arrangement when said drum means is mated with the raised lip circumferentially surrounding said movable means, and b.) said raised lip further acting as a basin to retain any spillage resulting from damage to said means for receiving disposed matter.

6. A trash container apparatus in accordance with claim 1 and further comprising, a protrusion extending around the circumference of the small drum opening.

7. A trash container apparatus in accordance with claim 1 wherein said receiving means comprises, a flexible bag for placement in said drum means, and wherein a circumference of the bag's opening is extended over the smaller drum opening and the protrusion.

8. A trash container apparatus in accordance with claim 7 and further including, a tie means for fitting over the protrusion and extending around said smaller drum opening for attaching said flexible bag to said drum means.

9. A trash container apparatus in accordance with claim 8 wherein said tie means is elastic.

* * * * *